US006604441B2

(12) United States Patent
Lin

(10) Patent No.: US 6,604,441 B2
(45) Date of Patent: Aug. 12, 2003

(54) CONNECTOR FOR A TOOL

(75) Inventor: Chorng-Jiang Lin, Taichang (TW)

(73) Assignee: Chuck Chang, Taichang (TW)

( * ) Notice: Subject to any disclaimer, the term of this patent is extended or adjusted under 35 U.S.C. 154(b) by 0 days.

(21) Appl. No.: 09/972,985

(22) Filed: Oct. 10, 2001

(65) Prior Publication Data

US 2003/0066395 A1 Apr. 10, 2003

(30) Foreign Application Priority Data

May 2, 2001 (TW) ..... 90207226 U

(51) Int. Cl.[7] ..... B25B 23/16
(52) U.S. Cl. ..... 81/177.2; 81/180.1; 81/60
(58) Field of Search ..... 81/58.1, 60–63.2, 81/121.1, 119, 177.2, 177.85, 180.1, 185

(56) References Cited

U.S. PATENT DOCUMENTS 326,876 A * 9/1885 Kramer et al. ..... 81/177.85
581,427 A * 4/1897 Olson ..... 81/177.85
1,047,634 A * 12/1912 Hoffmann ..... 81/177.85
1,084,937 A * 1/1914 Frueh ..... 81/58.1
3,875,829 A * 4/1975 Evans et al. ..... 81/177.2
4,817,475 A * 4/1989 Kelly et al. ..... 81/177.85
5,216,940 A * 6/1993 Hedden ..... 81/177.2
6,345,554 B1 * 2/2002 Wang ..... 81/177.2
6,382,057 B1 * 5/2002 Kienholz ..... 81/177.2

* cited by examiner

*Primary Examiner*—James G. Smith
(74) *Attorney, Agent, or Firm*—Rosenberg, Klein & Lee

(57) ABSTRACT

A connector includes a body provided with a polygonal drive end that may be driven by a tool, the drive end provided with an engaging portion, and an urging body secured on the drive end of the body, and provided with an engaging portion engaged with the engaging portion of the drive end of the body, so that the tool is urged and secured between the urging body and the drive end of the body. Thus, the body of the connector and the tool may be combined integrally, whereby the connector may be exactly secured on the tool, so that the tool may function as a ratchet wrench.

6 Claims, 13 Drawing Sheets

CONNECTOR FOR A TOOL

BACKGROUND OF THE INVENTION

1. Field of the Invention

The present invention relates to a connector for a tool, wherein the body of the connector and the tool may be combined integrally, whereby the connector may be exactly secured on the tool, so that the tool may function as a ratchet wrench.

2. Description of the Related Art

A conventional tool such as an open-ended spanner or the like does not have the function of a ratchet wrench. Thus, when the conventional open-ended spanner is used to rotate a workpiece such as a nut or the like to a determined rotation angle, the open-ended spanner has to detach from the workpiece, and to be re-fit on the workpiece reciprocally so as to rotate the workpiece again, thereby causing inconvenience to the user, and thereby decreasing the versatility of the conventional tool.

SUMMARY OF THE INVENTION

The primary objective of the present invention is to provide a connector for a tool, wherein the body of the connector and the tool may be combined integrally, whereby the connector may be exactly secured on the tool, so that the tool may function as a ratchet wrench.

In accordance with the present invention, there is provided a connector comprising:

a body provided with a polygonal drive end that may be driven by a tool, the drive end provided with an engaging portion; and an urging body secured on the drive end of the body, and provided with an engaging portion engaged with the engaging portion of the drive end of the body, so that the tool is urged and secured between the urging body and the drive end of the body.

Further benefits and advantages of the present invention will become apparent after a careful reading of the detailed description with appropriate reference to the accompanying drawings.

DETAILED DESCRIPTION OF THE INVENTION

Figures 1, 1A:
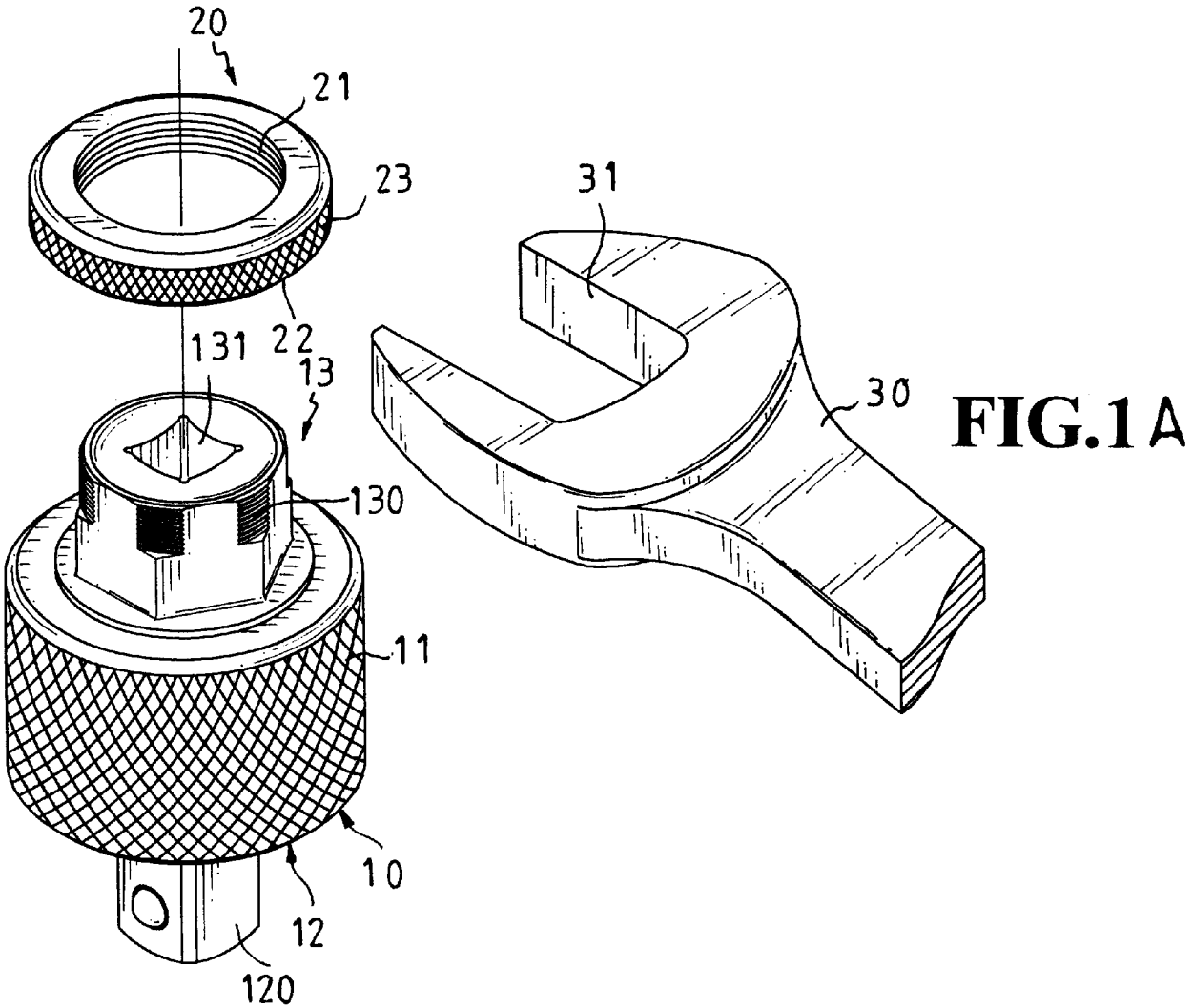
FIG. 1 is an exploded perspective view of a connector for a tool in accordance with a first embodiment of the present invention.
FIG. 1A is a perspective view of a tool in accordance with the first embodiment of the present invention.
Figure 2:
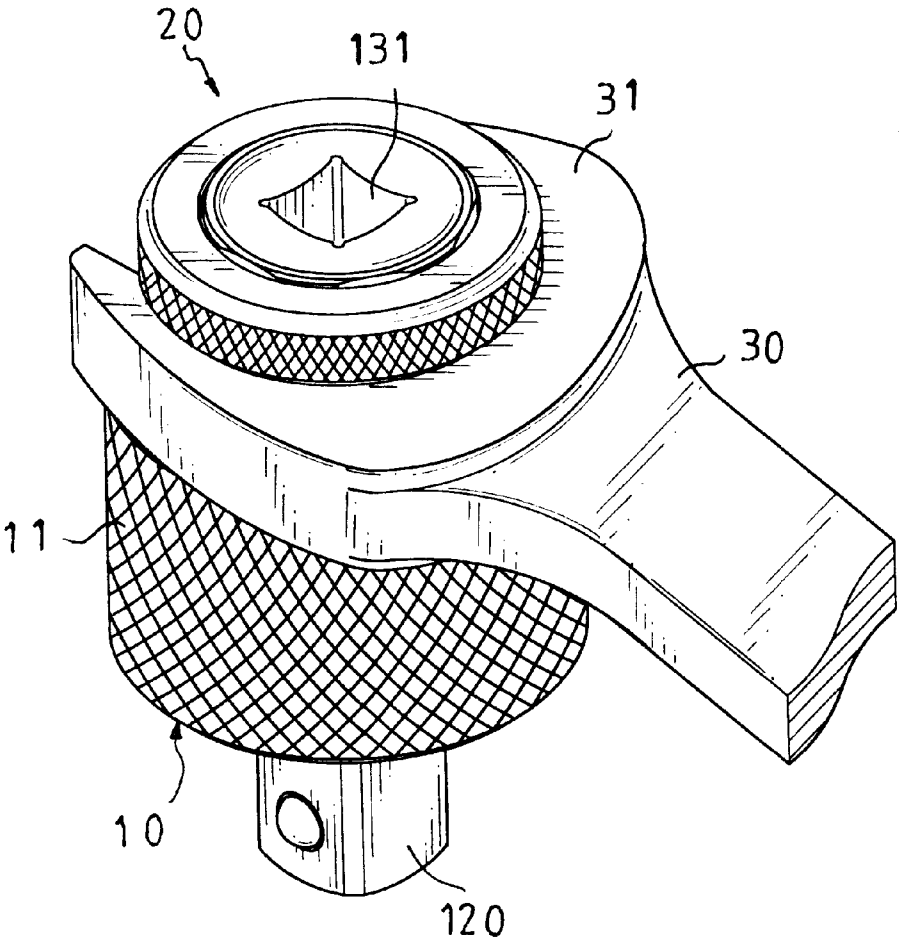
FIG. 2 is a perspective assembly view of the connector for a tool as shown in FIG. 1.

Referring to the drawings and initially to FIGS. 1–6, a connector for a tool, such as an open-ended spanner, a closed ended spanner or the like, in accordance with a first embodiment of the present invention comprises a body 10 having an outer periphery formed with a friction face 11 such that the user may directly rotate the body 10 by his fingers in a frictional manner. The body 10 has a first end provided with a drive body 12 having the form of a ratchet wheel. A rectangular locking end 120 with a ball is formed on and protruded from a center of the drive body 12. The body 10 has a second end provided with a polygonal drive end 13 that may be driven by a drive head 31 of an open-ended spanner 30 as shown in FIG. 1 or driven by a drive head 31A of a closed ended spanner 30A as shown in FIG. 1A. The drive end 13 has a center formed with a rectangular drive recess 131. The drive end 13 has an outer wall having an upper portion provided with an engaging portion 130 that is in the form of an outer thread.

A ring-shaped urging body 20 is secured on the upper portion of the outer wall of the drive end 13, and has an inner wall formed with an engaging portion 21 engaged with the engaging portion 130 of the drive end 13. The engaging portion 21 of the urging body 20 is in the form of an inner thread screwed on the outer thread of the engaging portion 130 of the drive end 13, so that the urging body 20 may be rotated to move on the drive end 13 to adjust the distance between the body 10 and the urging body 20, thereby urging and securing the drive head 31 of the open-ended spanner 30 as shown in FIG. 1 or the drive head 31A of the closed ended spanner 30A as shown in FIG. 1A on the drive end 13 of the body 10 and between the body 10 and the urging body 20. The urging body 20 has an outer wall formed with a drive portion 23 that is in the form of an anti-skid friction face, thereby increasing the driving force of the user's hand on the urging body 20.

When the drive head 31 of the open-ended spanner 30 or the drive head 31A of the closed ended spanner 30A is mounted on the drive end 13 of the body 10, the urging body 20 may be screwed on the drive end 13 to move along the drive end 13 until the drive head 31 of the open-ended spanner 30 or the drive head 31A of the closed ended spanner 30A is exactly urged and secured by the urging body 20. Thus, the body 10 and the tool are combined integrally, whereby the connector may be exactly secured on the tool, so that the tool such as the open-ended spanner 30 or the closed ended spanner 30A may function as a ratchet wrench.

Figure 3:
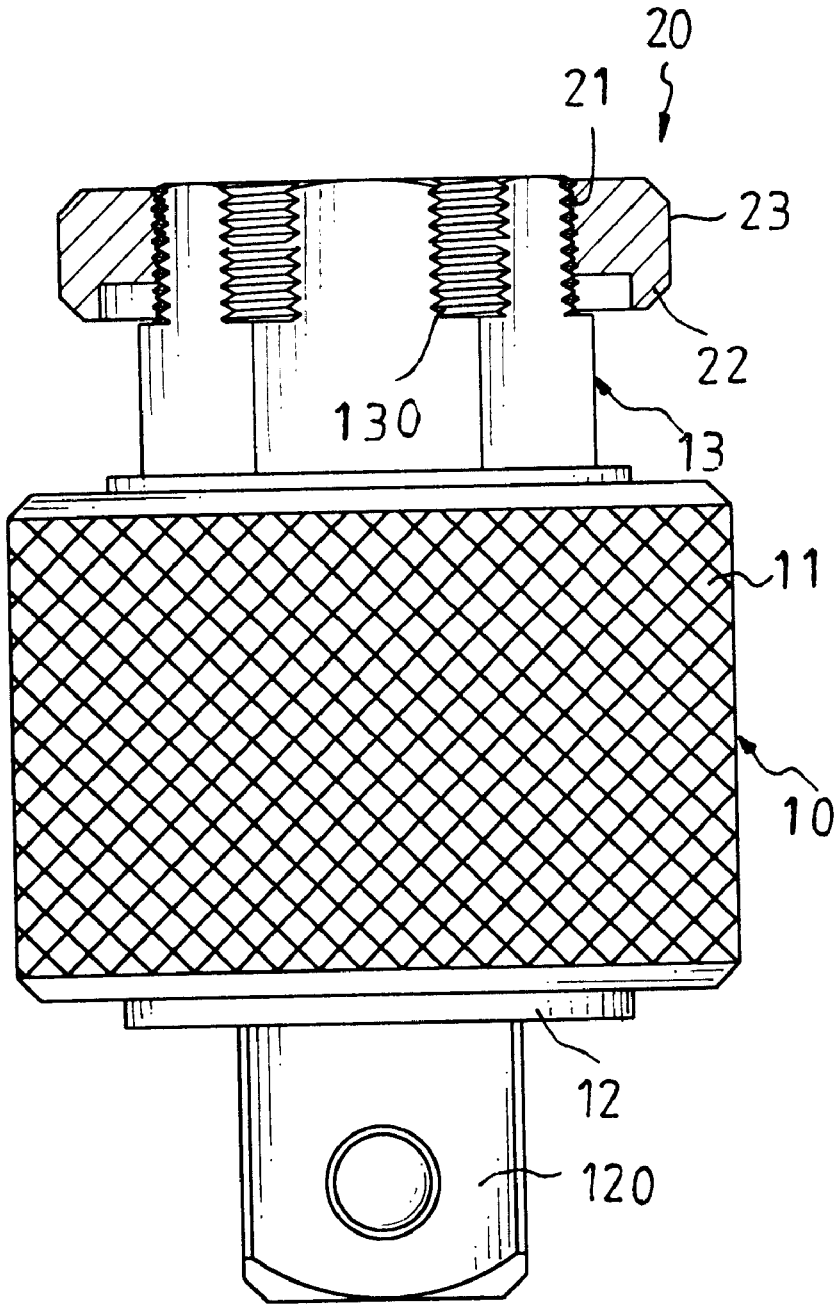
FIG. 3 is a front plan cross-sectional view of the connector for a tool as shown in FIG. 2.
Figure 4:
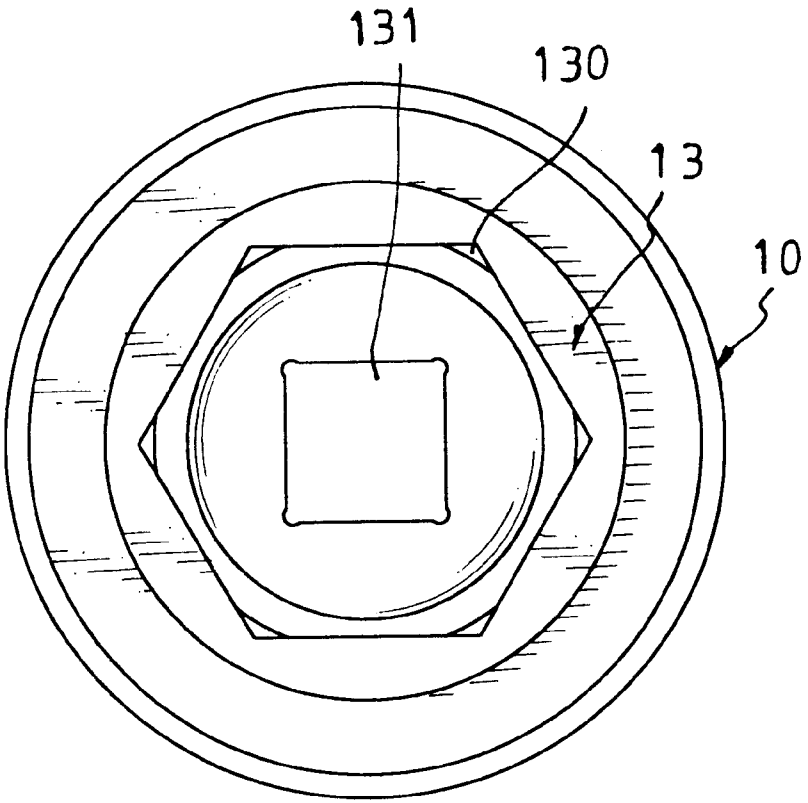
FIG. 4 is a top plan view of the connector for a tool as shown in FIG. 2.
Figure 5:
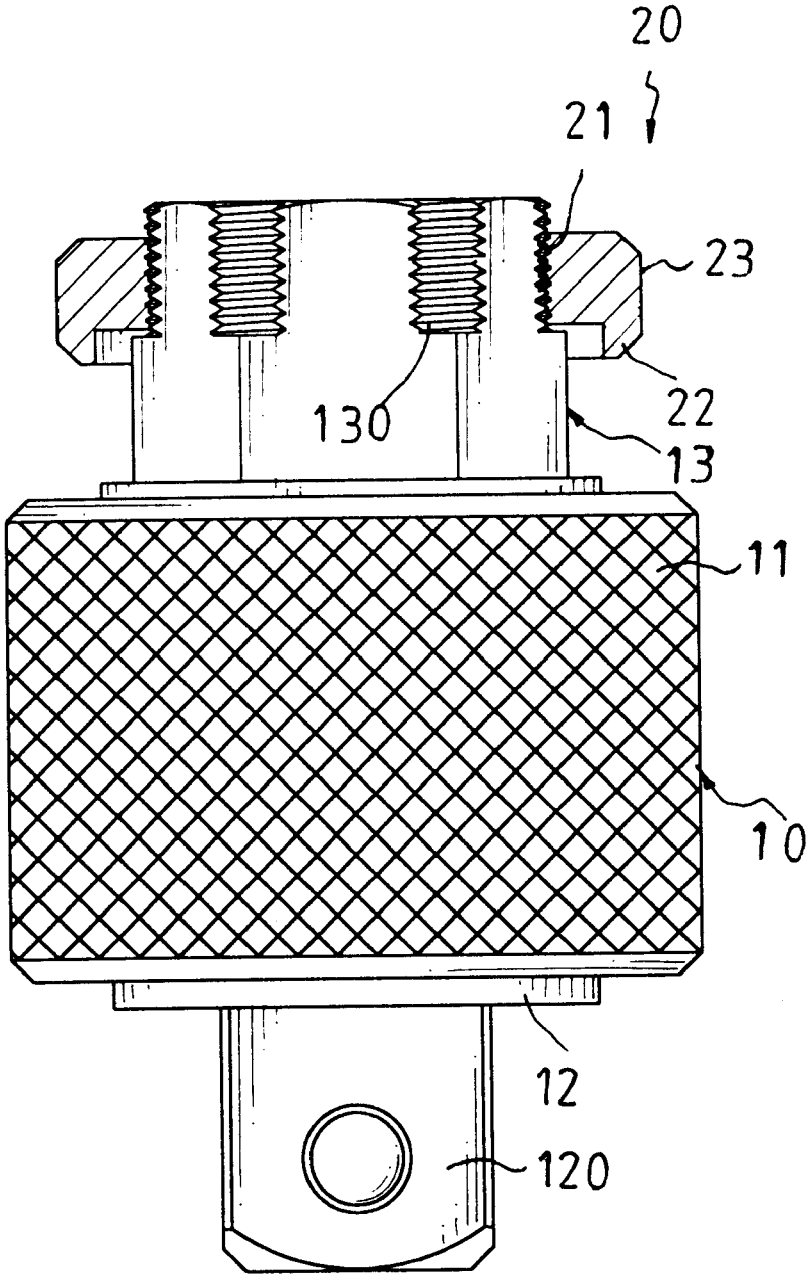
FIG. 5 is a schematic operational view of the connector for a tool as shown in FIG. 3.
Figure 6:
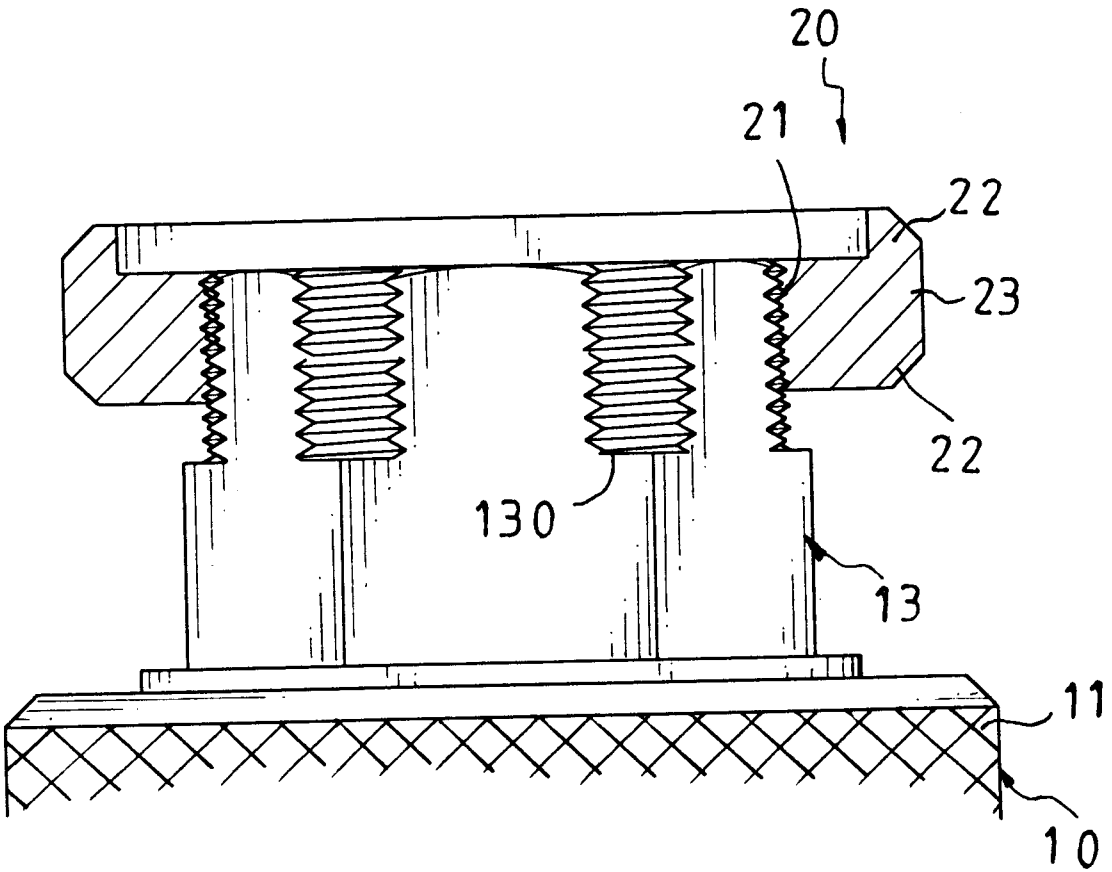
FIG. 6 is a schematic operational view of the connector for a tool as shown in FIG. 3.

The urging body 20 has a bottom formed with a recessed extension portion 22 having an inner diameter greater than that of the engaging portion 21. When the urging body 20 is screwed on the drive end 13 to move along the drive end 13, the extension portion 22 may be located at the positions as shown in FIGS. 3, 5 and 6, thereby changing and adjusting the distance between the body 10 and the urging body 20, so that the connector may be used to secure tools of different thickness.

Accordingly, the connector for a tool in accordance with the present invention has the following advantages.

1. When the drive head of the tool is mounted on the drive end of the body, the body of the connector and the drive head of the tool are combined integrally by urging and locking of the urging body, so that the connector may be exactly secured on the drive head of the tool, thereby facilitating operation of the tool.

2. The connector and the tool are combined integrally, so that the tool, such as the open-ended spanner or the closed ended spanner, may function as a ratchet wrench, thereby enhancing the versatility of the tool.

3. The connector may be used to secure tools of different thickness by provision of the extension portion of the urging body, thereby enhancing the versatility of the connector.

Figure 7:
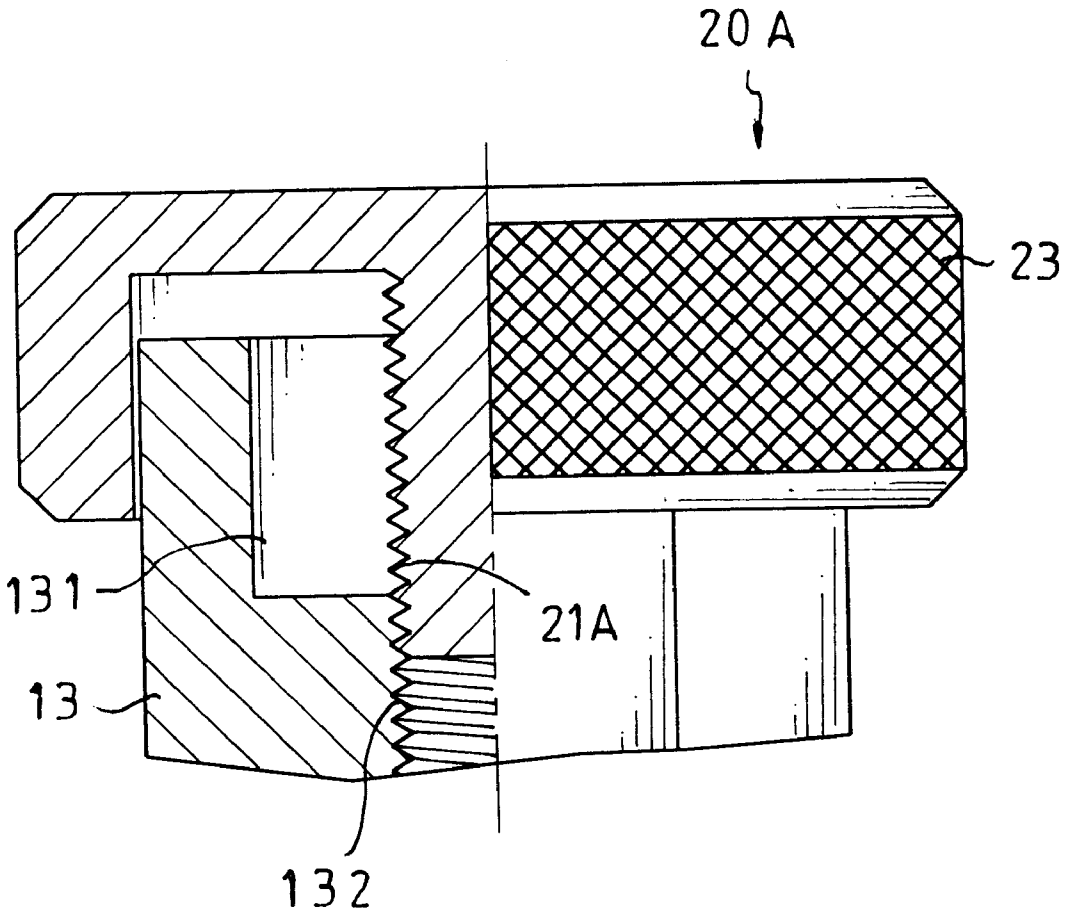
FIG. 7 is a front plan cross-sectional assembly view of a connector for a tool in accordance with a second embodiment of the present invention.

Referring to FIG. 7, the connector for a tool in accordance with a second embodiment of the present invention comprises a cap-shaped urging body 20A having a center formed with an engaging portion 21A that is in the form of a threaded column extended downward. The drive recess 131 of the drive end 13 of the body 10 has a bottom formed with an engaging portion 132 that is in the form of an inner thread, whereby the engaging portion 21A of the urging body 20A may be screwed in the engaging portion 132 of the drive end 13 of the body 10, so that the urging body 20A may be rotated and moved relative to the drive end 13 of the body 10 to secure the tool.

Figure 8:
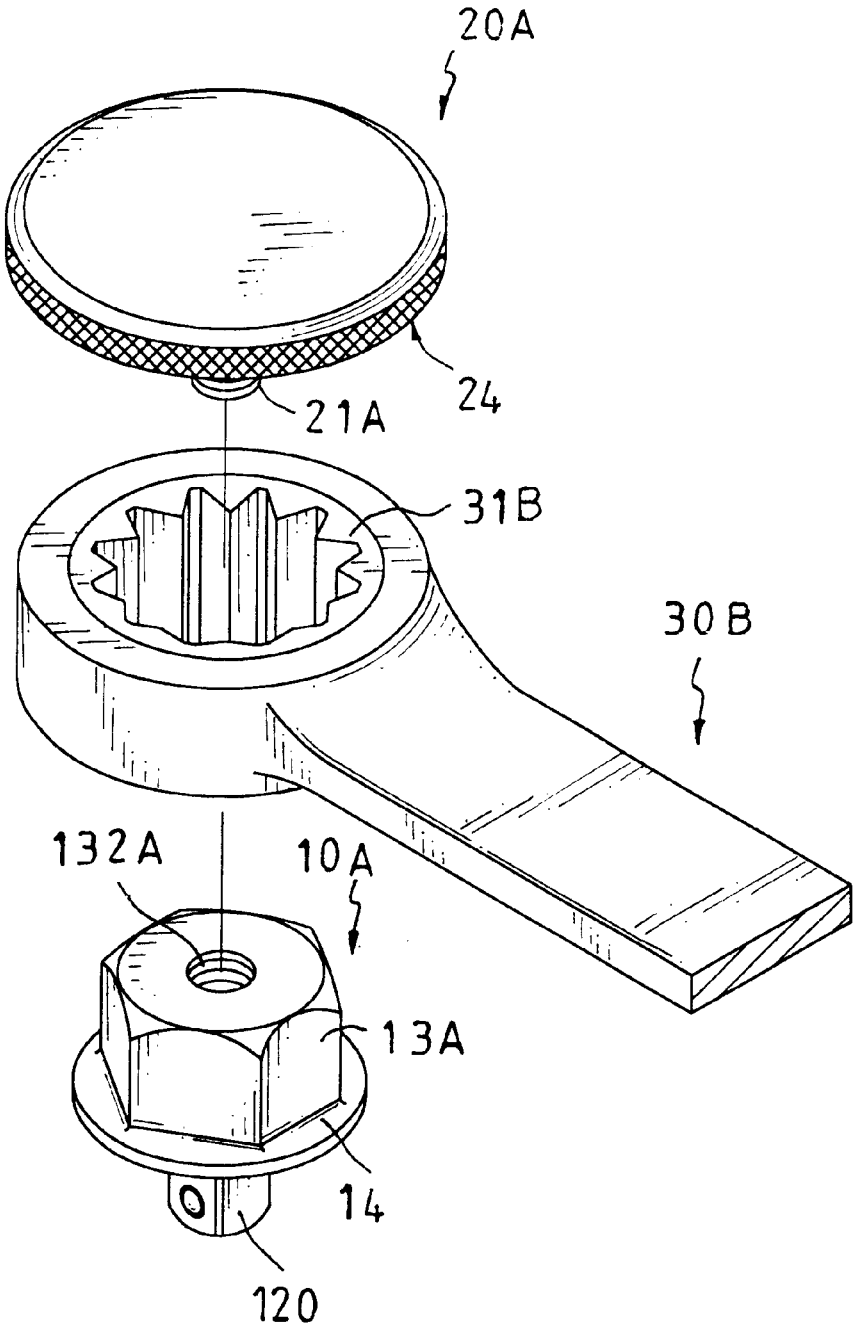
FIG. 8 is an exploded perspective view of a connector for a tool in accordance with a third embodiment of the present invention.
Figure 9:
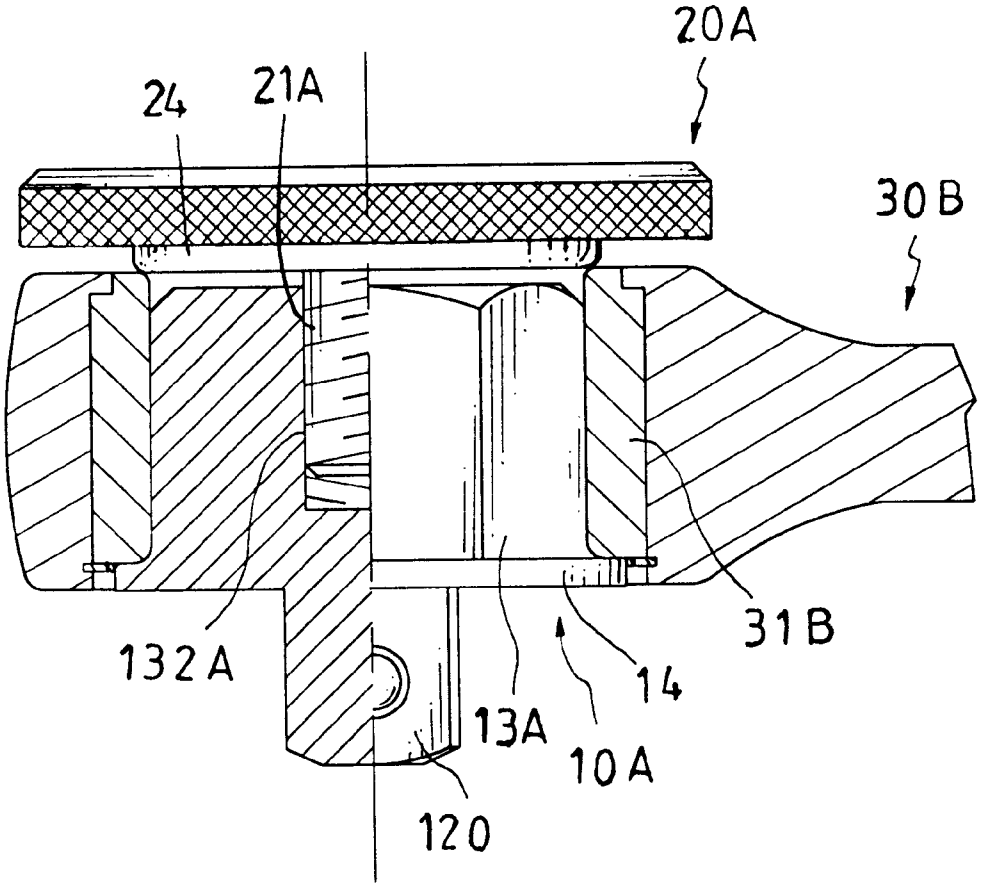
FIG. 9 is a front plan cross-sectional assembly view of the connector for a tool as shown in FIG. 8.

Referring to FIGS. 8 and 9, the connector for a tool in accordance with a third embodiment of the present invention comprises a cap-shaped urging body 20A having a center formed with an engaging portion 21A that is in the form of a threaded column extended downward. The drive end 13A of the body 10A is provided with an engaging portion 132A that is in the form of an inner thread. When a ratchet drive end 31B of a closed ended spanner 30B is mounted on the drive end 13A of the body 10A, the engaging portion 21A of the urging body 20A may be screwed in the engaging portion 132A of the drive end 13A of the body 10A, so that the urging body 20A may be rotated and moved relative to the drive end 13A of the body 10A to secure the ratchet drive end 31B of the closed ended spanner 30B.

A stepped urging portion 24 is formed on and protruded from the bottom of the urging body 20A, and rested on a top face of the ratchet drive end 31B of the closed ended spanner 30B. A flange-shaped urging portion 14 is formed on and protruded from the bottom of the drive end 13A of the body 10A, and rested on a bottom face of the ratchet drive end 31B of the closed ended spanner 30B. Thus, the ratchet drive end 31B of the closed ended spanner 30B may be urged between the urging portion 24 and the urging portion 14, so that the drive end 13A of the body 10A may be exactly secured in and driven by the ratchet drive end 31B of the closed ended spanner 30B. A rectangular locking end 120A with a ball is formed on and protruded from the body 10A, so that the closed ended spanner 30B may be used to mate with a socket to function as a socket wrench.

Figure 10:
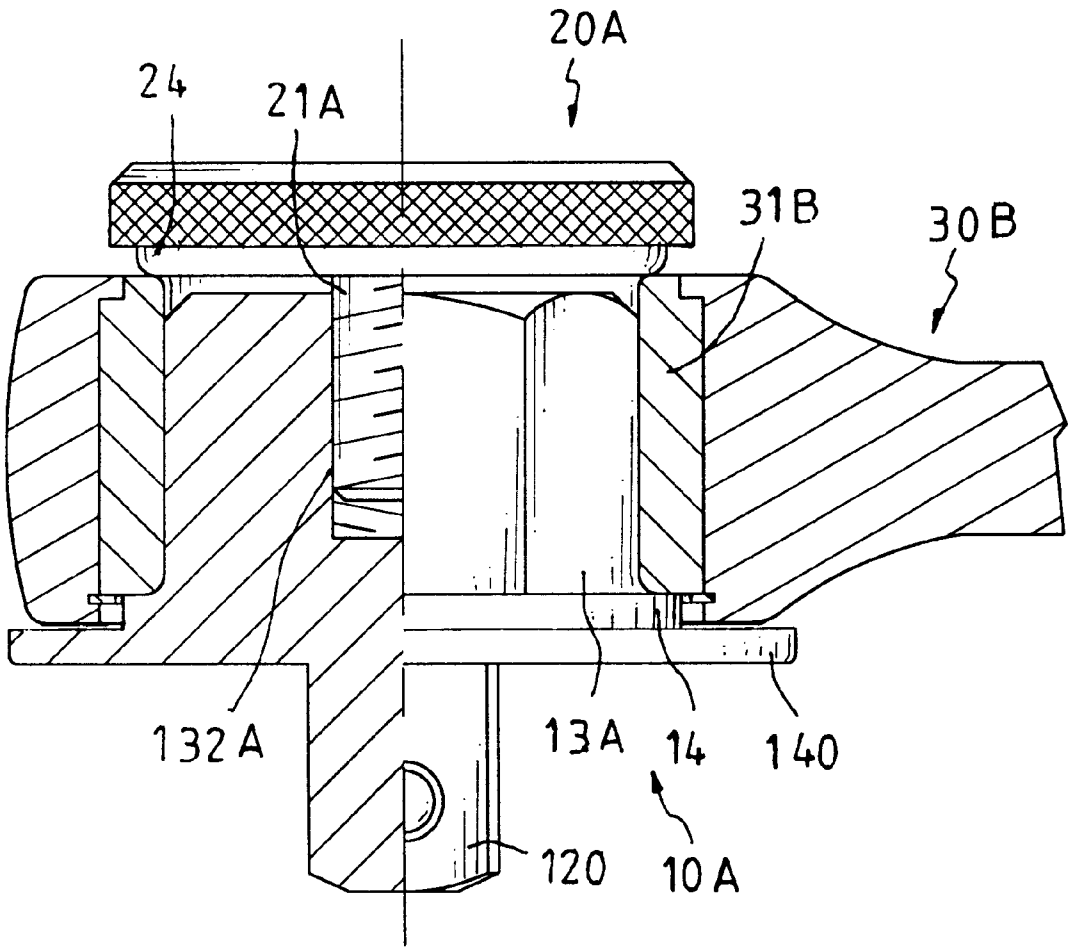
FIG. 10 is a front plan cross-sectional assembly view of a connector for a tool in accordance with another embodiment of the present invention.

Referring to FIG. 10, a rotation disk 140 is formed on and protruded from the bottom of the urging portion 14, and has an outer diameter exceeding that of the ratchet drive end 31B of the closed ended spanner 30B, so that the user may rotate the rotation disk 140 easily.

Figure 11:
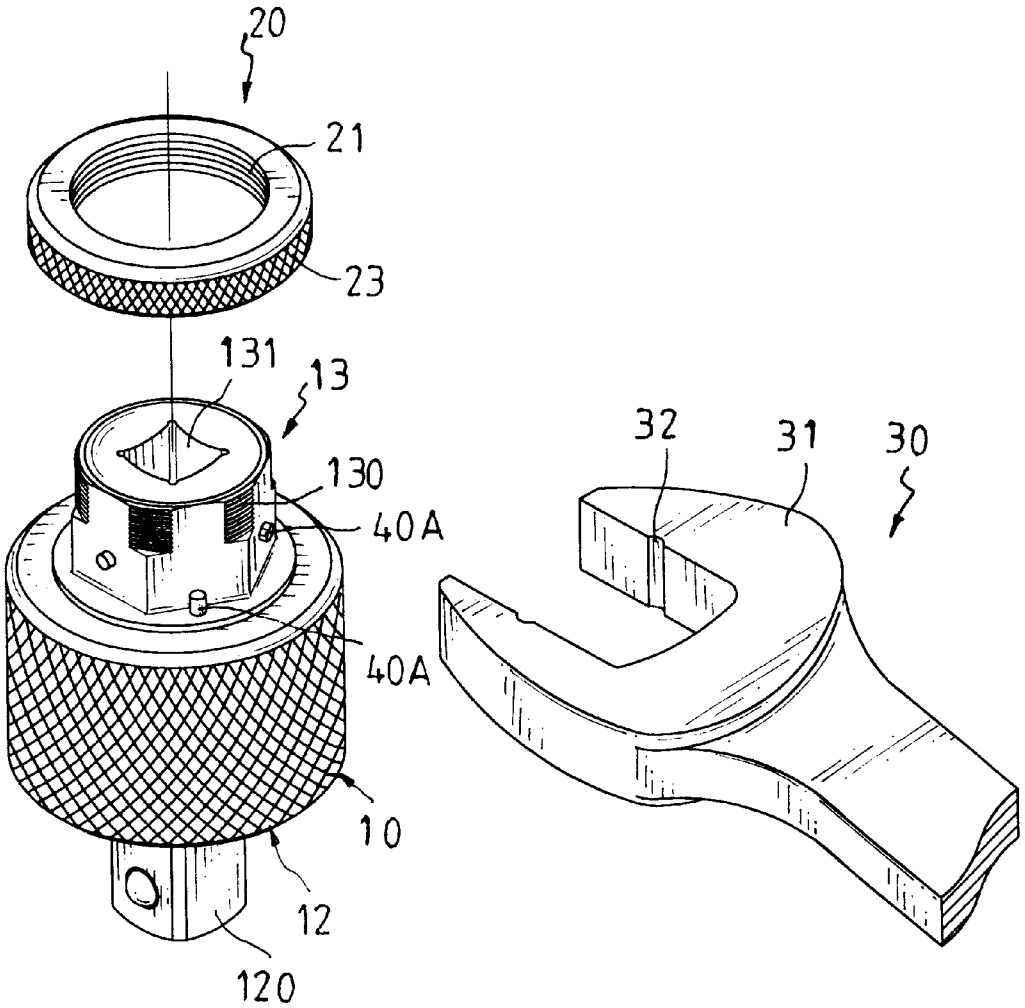
FIG. 11 is an exploded perspective view of a connector for a tool in accordance with a fourth embodiment of the present invention.

Referring to FIG. 11, in accordance with a fourth embodiment of the present invention, the outer wall of the drive end 13 of the body 10 is provided with multiple locking members 40A, and the drive head 31 of the open-ended spanner 30 is formed with recessed locking portions 32 for locking the locking members 40A of the drive end 13 of the body 10, thereby preventing the drive head 31 of the open-ended spanner 30 from detaching from the drive end 13 of the body 10 in a horizontal direction.

Figure 12:
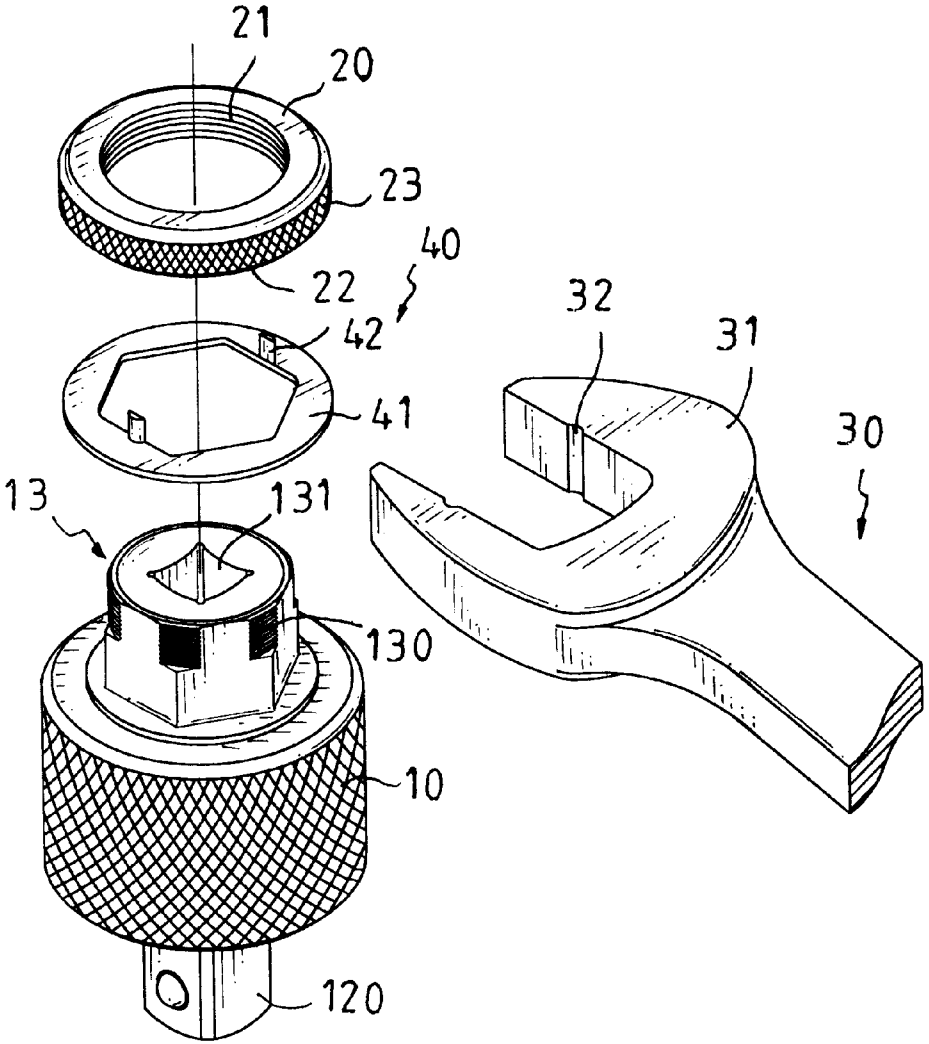
FIG. 12 is an exploded perspective view of a connector for a tool in accordance with a fifth embodiment of the present invention.

Referring to FIG. 12, in accordance with a fifth embodiment of the present invention, a locking member 40 has a ring-shaped mounting portion 41 mounted on the outer wall of the drive end 13 of the body 10 and having an inner wall provided with two opposite locking portions 42. The drive head 31 of the open-ended spanner 30 is formed with two opposite recessed locking portions 32 for locking the locking portions 42 of the locking member 40, thereby preventing the drive head 31 of the open-ended spanner 30 from detaching from the drive end 13 of the body 10 in a horizontal direction.

Figure 13:
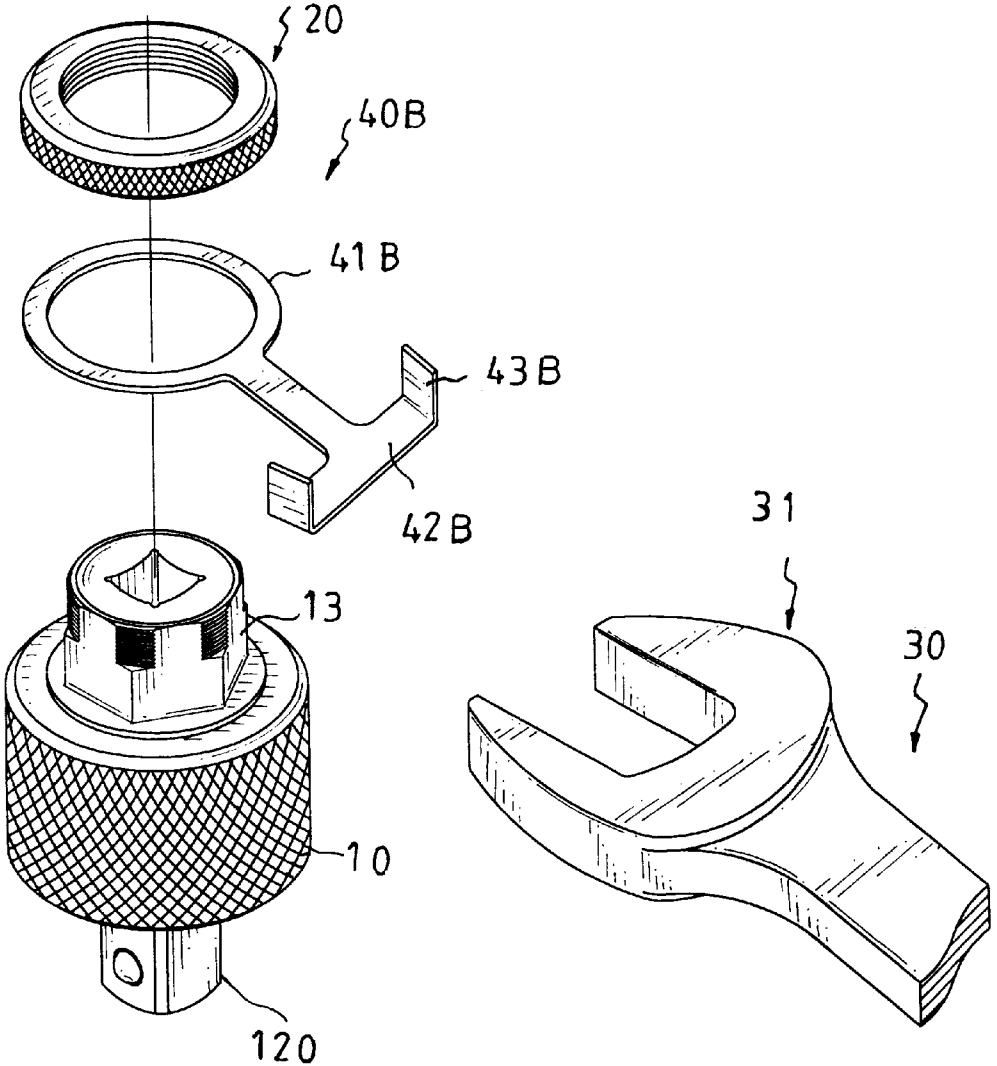
FIG. 13 is an exploded perspective view of a connector for a tool in accordance with a sixth embodiment of the present invention.

Referring to FIG. 13, in accordance with a sixth embodiment of the present invention, a locking member 40B has a ring-shaped mounting portion 41B mounted on the outer wall of the drive end 13 of the body 10 and provided with a T-shaped extension 42B formed with two hook portions 43B hooking the outer edge of the drive head 31 of the open-ended spanner 30, thereby preventing the drive head 31 of the open-ended spanner 30 from detaching from the drive end 13 of the body 10 in a horizontal direction.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A connector comprising:

a body provided with a drive end that can be driven by a tool, the drive end provided with an engaging portion;

an urging body secured on the drive end of the body, and provided with an engaging portion engaged with the engaging portion of the drive end of the body, so that the tool is urged and secured between a bottom of the urging body and a top of the body; and a locking member mounted on the top of the body and having a ring-shaped mounting portion fixed on an outer wall of the drive end of the body, the mounting portion being provided with two opposite protruding locking portions, wherein:

the tool is formed with two opposite recessed locking portions secured on the locking portions of the locking member, thereby preventing the tool from detaching from the drive end of the body in a horizontal direction.

2. The connector in accordance with claim 1, wherein the body has an outer periphery formed with a friction face such that a user can directly rotate the body by his fingers in a frictional manner.

3. The connector in accordance with claim 1, wherein the drive end of the body has a center formed with a rectangular drive recess.

4. The connector in accordance with claim 1, wherein the engaging portion of the drive end of the body is an outer thread, and the engaging portion of the urging body is an inner thread screwed on the outer thread of the engaging portion of the drive end.

5. The connector in accordance with claim 1, wherein the urging body has an outer wall formed with a drive portion that is an anti-skid friction face.

6. The connector in accordance with claim 1, wherein the urging body has a bottom formed with a recessed extension portion having an inner diameter greater than that of the engaging portion of the urging body.

* * * * *